US008829319B2

(12) United States Patent
Martinazzi

(10) Patent No.: US 8,829,319 B2
(45) Date of Patent: Sep. 9, 2014

(54) PERCUSSION INSTRUMENT

(76) Inventor: Riccardo Martinazzi, Brescia (IT)

( * ) Notice: Subject to any disclaimer, the term of this patent is extended or adjusted under 35 U.S.C. 154(b) by 213 days.

(21) Appl. No.: 13/391,408

(22) PCT Filed: Sep. 10, 2010

(86) PCT No.: PCT/IB2010/054098

§ 371 (c)(1),
(2), (4) Date: Feb. 21, 2012

(87) PCT Pub. No.: WO2011/033434

PCT Pub. Date: Mar. 24, 2011

(65) Prior Publication Data

US 2012/0174732 A1 Jul. 12, 2012

(30) Foreign Application Priority Data

Sep. 18, 2009 (IT) ..... BS2009A0174

(51) Int. Cl.
*G10D 13/02* (2006.01)

(52) U.S. Cl.
USPC ..... 84/411 R

(58) Field of Classification Search
USPC ..... 84/411 R, 421
See application file for complete search history.

(56) References Cited

U.S. PATENT DOCUMENTS

| | | | | |
|---|---|---|---|---|
| 578,198 | A | 3/1897 | Boulanger | |
| 3,215,021 | A | 11/1965 | Kester, Jr. | |
| 4,300,437 | A * | 11/1981 | Hinger et al. | 84/411 R |
| 6,242,679 | B1 * | 6/2001 | Carlson | 84/411 R |
| 7,786,364 | B2 * | 8/2010 | Natali | 84/412 |
| 2009/0013850 | A1 | 1/2009 | Abe | |

FOREIGN PATENT DOCUMENTS

| | | |
|---|---|---|
| JP | 59 078396 | 5/1984 |
| JP | 7 077978 | 3/1995 |

* cited by examiner

*Primary Examiner* — Kimberly Lockett
(74) *Attorney, Agent, or Firm* — Shoemaker and Mattare

(57) ABSTRACT

This invention concerns a percussion instrument comprising a batter (10) and a resonant (12) drum both including a ring base (14), a lateral wall (16) that stands on it and a membrane (18) which is put in traction on it. The two drums are spaced each other and facing with their bases so as to define a lateral opening (20) for the air set in vibration by the two membranes.

11 Claims, 7 Drawing Sheets

PERCUSSION INSTRUMENT

This invention concerns a percussion instrument of a drum type.

As it is known, the drum is a tubular shell whose sound is produced by striking a membrane, for example a membrane, stretched across one end of the drum shell.

To maximize the vibration of the membrane, some instruments, such as the drums, use a resonant membrane on the base's bottom opposite to the batter drum. The shell, closed by the two membranes, acts as a sounding board. (FIG. 3)

In order to tune the instrument or to optimize the resonance, in these drums, lugs are used to adjust the membrane's tension. Any other membrane tension device may be adopted.

The object of the present invention is to propose an innovative percussion instrument, able to create a better resonant effect on the low notes and therefore a sound particularly rich and sustained.

This object is achieved by a percussion instrument according to claim 1.

The claims depending on claim 1 illustrate preferred embodiments of the percussion instrument.

The features and advantages of the percussion instrument according to this invention will be made clear by the description below including some realization examples, given as indicative but not limitative as shown in the attached drawings, in which.

Figure 5:
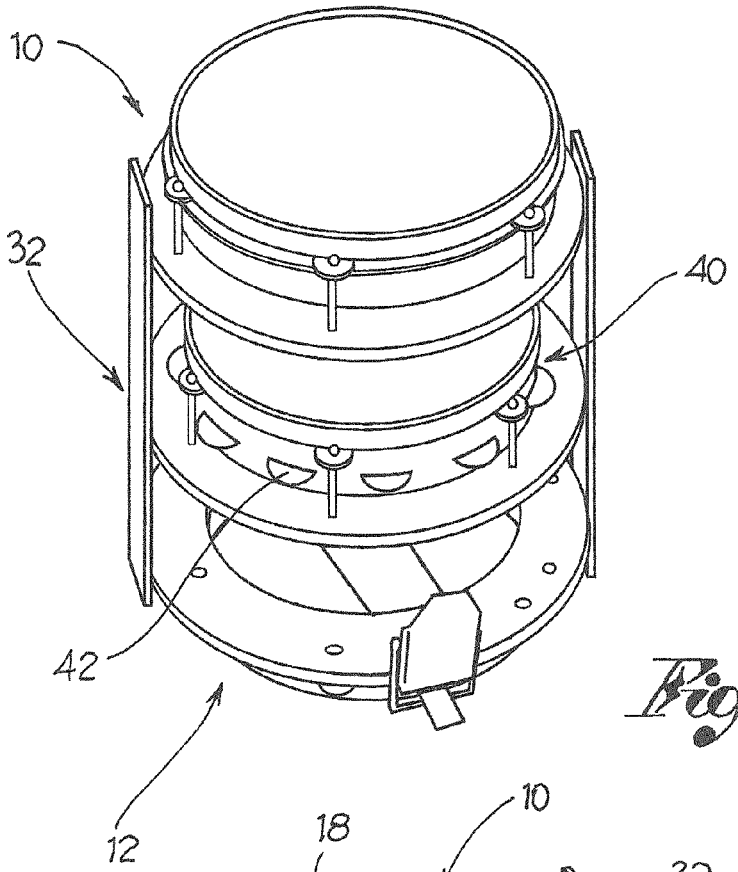
Figure 5A:
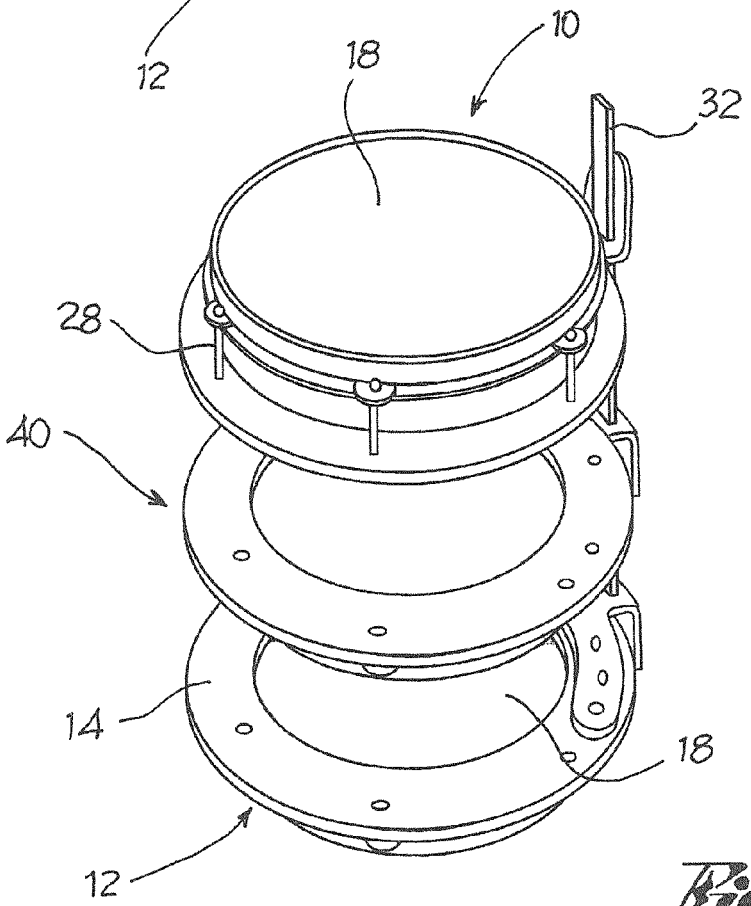
Figure 5B:
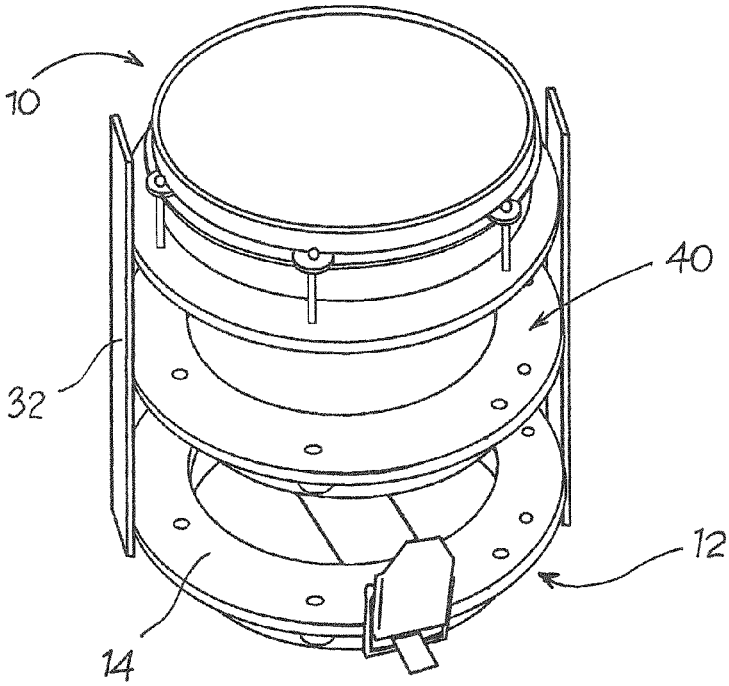
Figure 6:
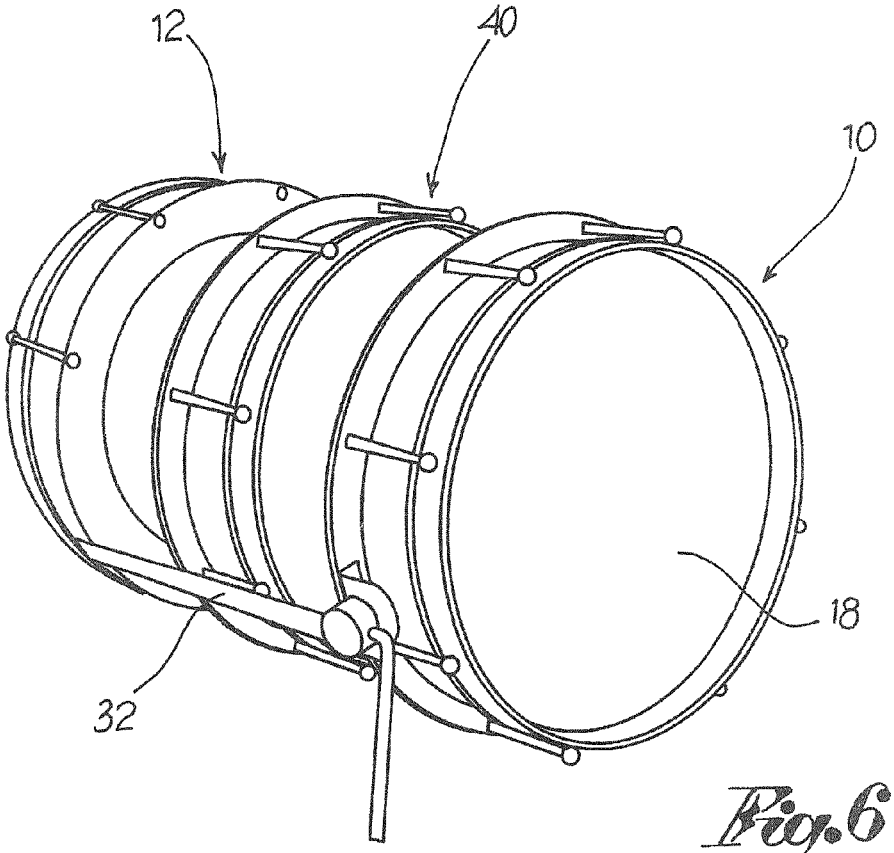
Figure 8:
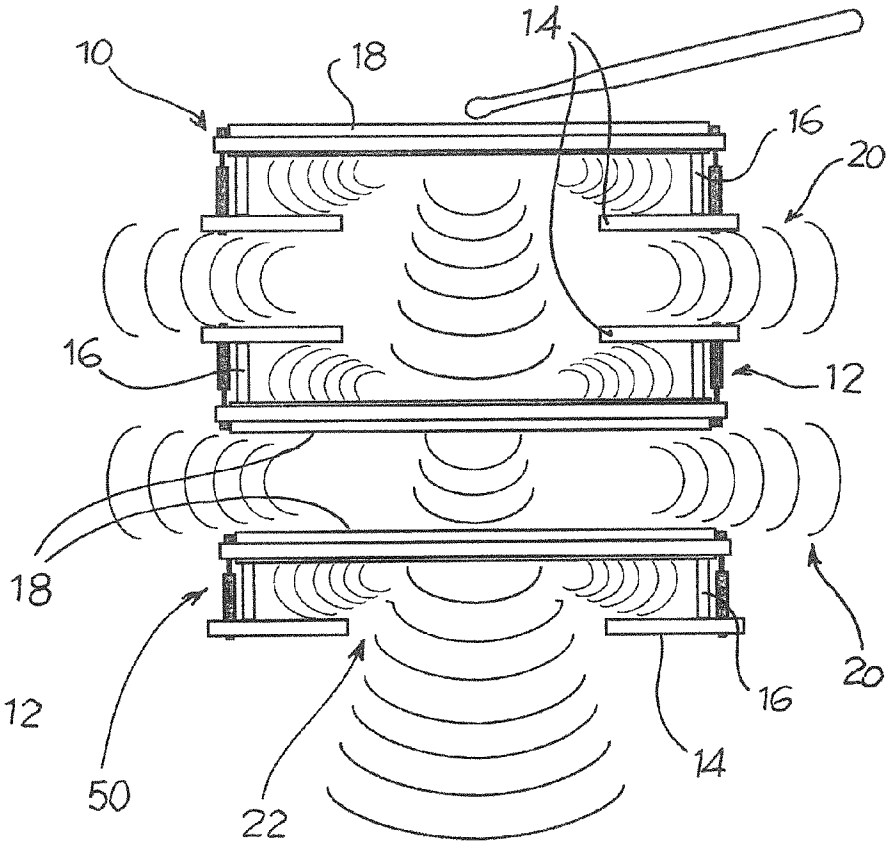
Figure 7:
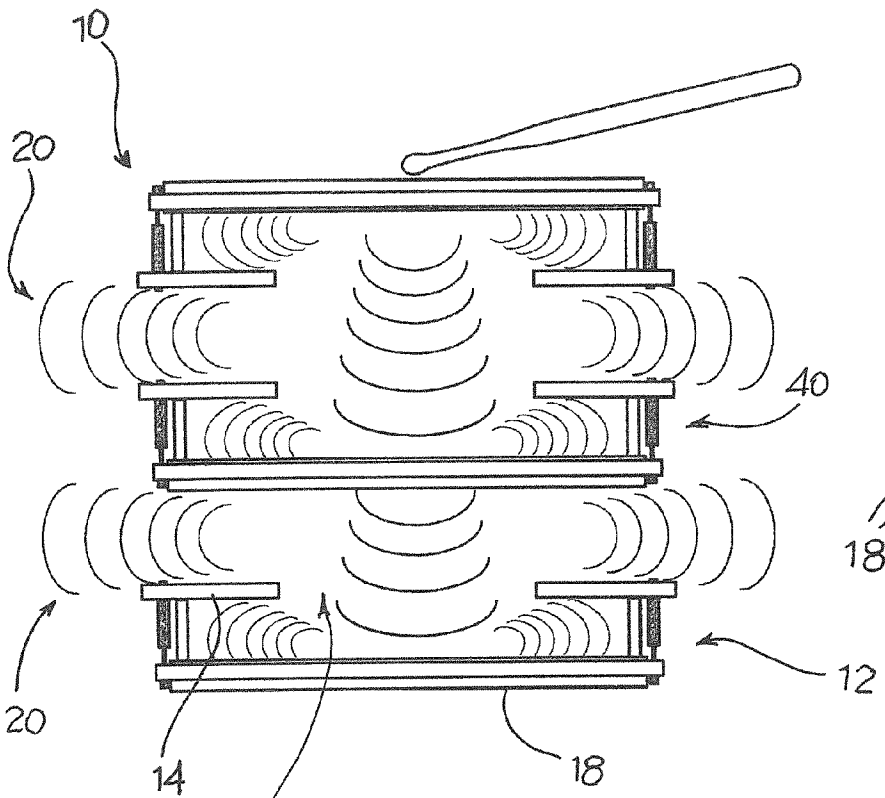
Figure 9:
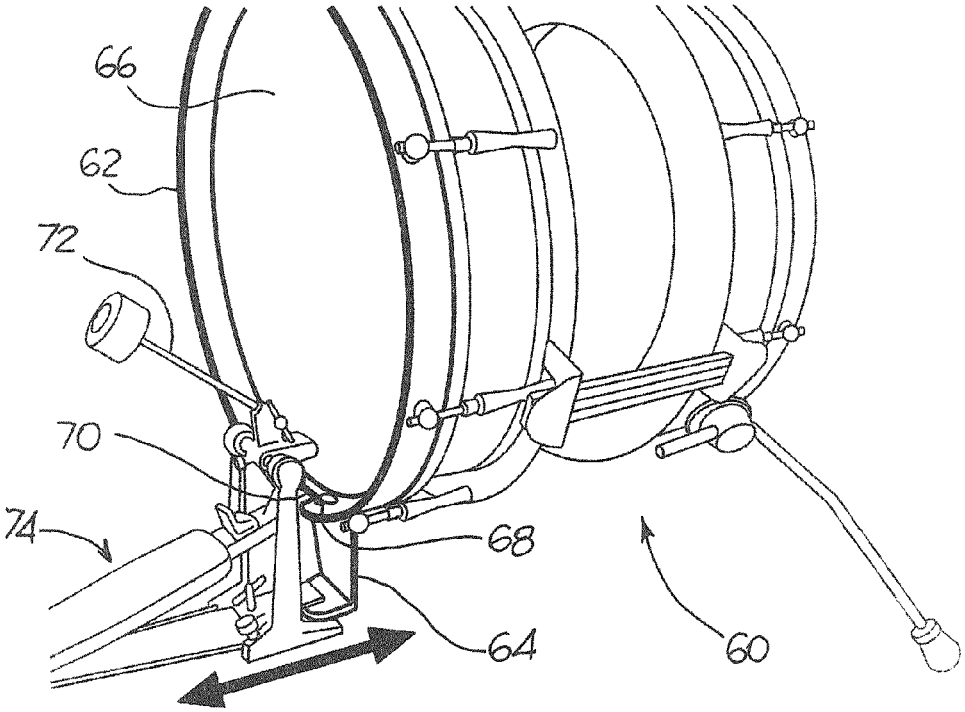

FIGS. 5, 5*a* and 5*b* show three different embodiments of a drum according to the invention;

FIG. 6 shows a bass drum in a different embodiment;

FIG. 7 shows a bass drum in a further embodiment;

FIG. 8 shows a bass drum in yet another embodiment;

FIG. 9 is a perspective view of a bass drum; and

Figure 9A:
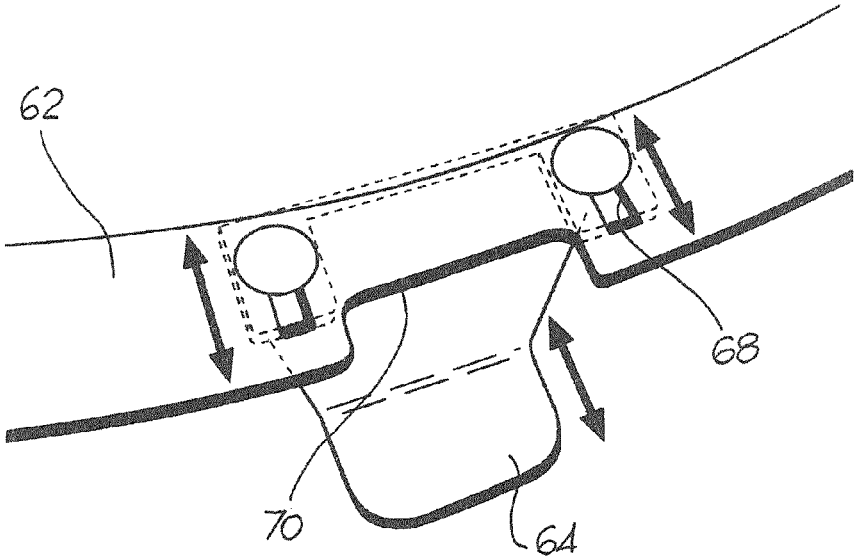

FIG. 9*a* is an enlarged view of a portion of the bass drum of FIG. 9.

In accordance with a general form of realization, the percussion instrument 1 includes a batter drum 10 and a resonant drum 12. Each drum includes a ring base 14, a lateral wall or shell 16 that stands on it and a membrane 18 which is put in tension on it.

The two drums are spaced each other and their bases are faced to define a lateral opening 20 for the air put in vibration by the two membranes.

More specifically, the base 14 of each drum has an inner circumference studied in order to constitute a central opening 22 that may enable the passage of sound waves 18 generated by the vibration of membranes and forming the main note of the instrument.

Furthermore, the base 14 of each drum has an inner circumference studied to constitute, with the top or bottom membrane a sound box 24 able to reflect the vibration 52 caused by the membrane producing low notes of support for the note struck on the batter drum.

According to a preferred embodiment, the base 14 of each drum consists of a ring, and the shell is fixed to this base. Usually in the instrument the height of each shell is shorter than the distance between the drums' bases.

Each membrane 18 is put in tension by lugs 28 connected to the external base circumference. For example, the outer circumference extends radially beyond the shell side of the drum to form a flange for the tension rods.

Each membrane is fixed to the respective shell or lateral wall by a retaining ring 30 and tie rods 28 connecting the ring to the base. The ring has the function to hold the membrane and, through the rods, to stretch it until the desired tune.

The two drums 10, 12 are connected together by support means 32 of variable extension, for example in the form of sledging, in order to adjust the distance between the two drums as needed.

Figure 1:
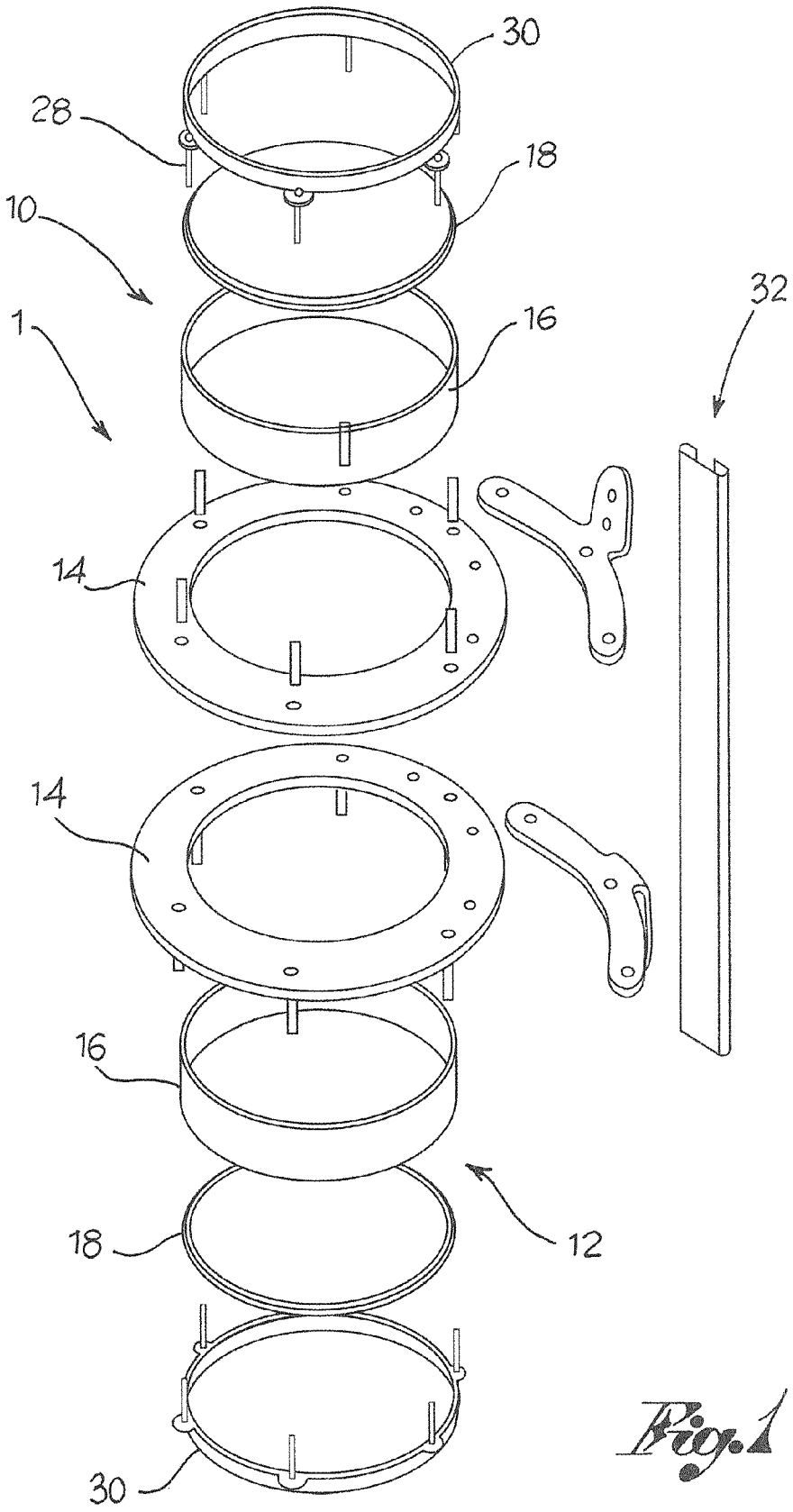
FIG. 1 is an exploded perspective view of the instrument according to this invention.
Figure 2:
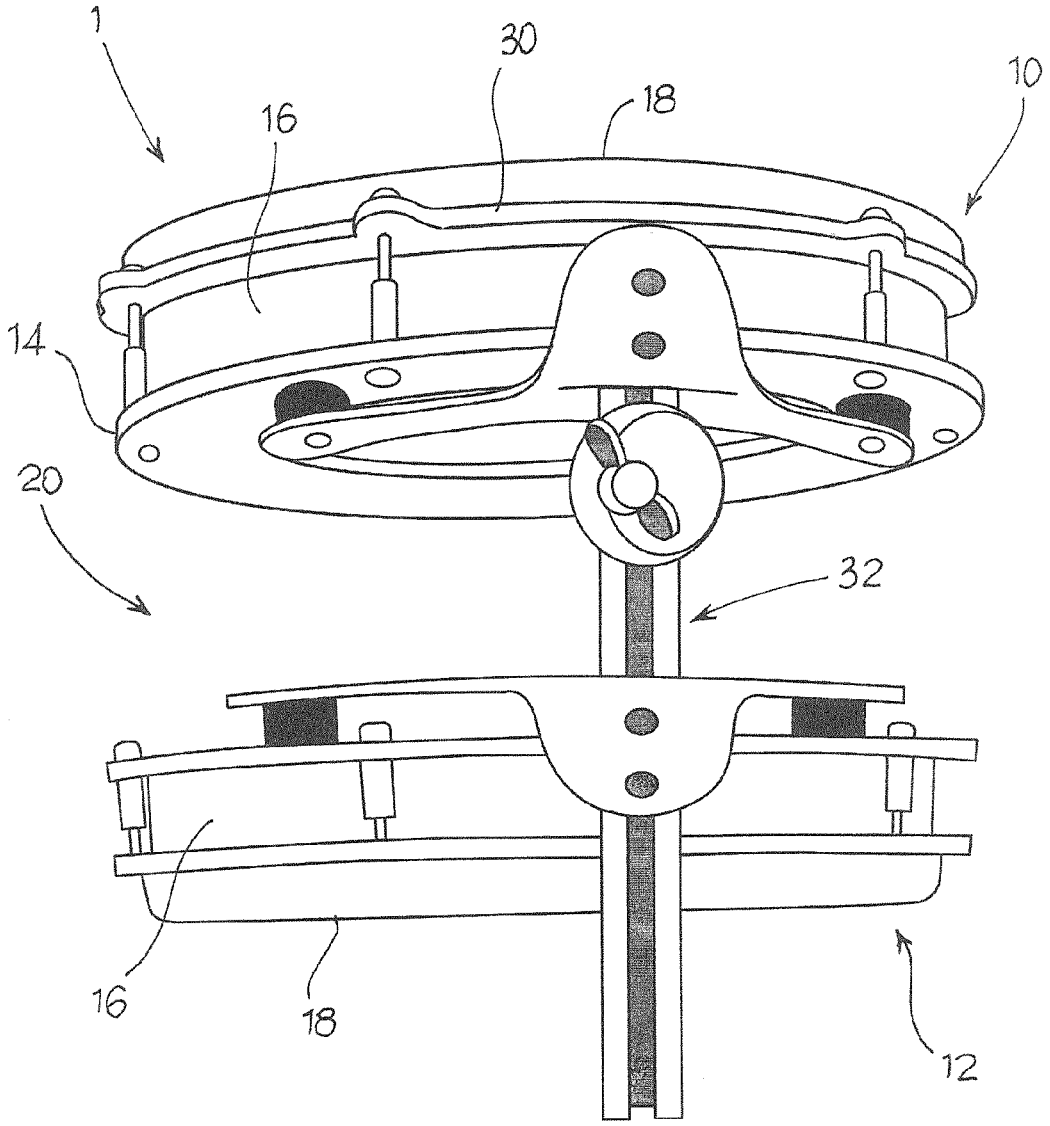
FIG. 2 is a perspective view of the assembled instrument.
Figure 3:
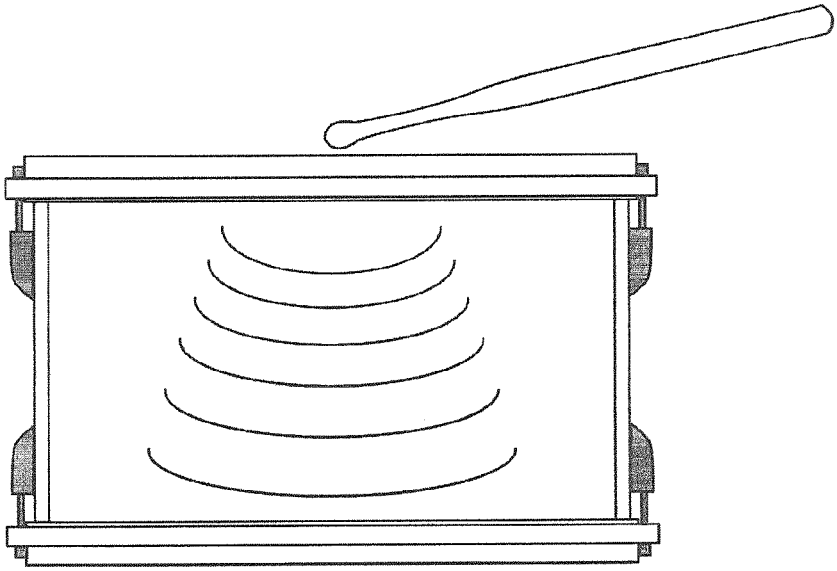
FIG. 3 depicts a schematic representation of the modulation of the sound waves in a traditional drum.
Figure 4:
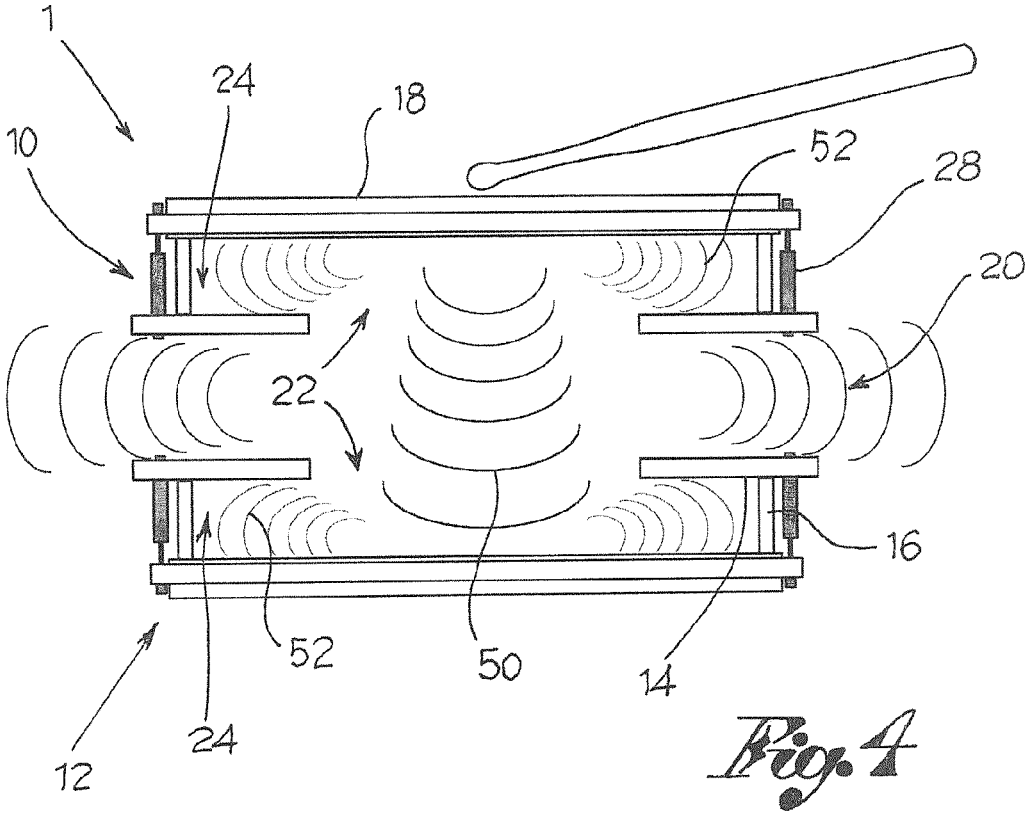
FIG. 4 depicts a schematic representation of the modulation of the sound waves in this instruments according to this invention.

To summarize, the innovation of this drum is that you can have a resonance on the low notes and a nearly infinite tuning, unlike traditional shells sealed by the two membranes of the traditional drum (FIG. 3).

From the opening 22 of each base ring 14, beating the membrane, an air mass and sound waves will move allowing the resonant drum to resonate and to make a very prolonged and deep sound.

Therefore it is proposed here a new method of transmission of sound waves in support of the note struck on the upper drum.

A further innovative aspect is given by the possibility to approach the two drums, through a movable frame 32, such as a chassis.

This permits a virtually infinite range of sounds because, due to the distance between the drums and the possibility to tune them, the emitted sound has infinite possibilities of variations and percussive tones.

The drum according to this invention allows the possibility to insert, into the sound box, some foam rubber that allows the drum to become an excellent silent instrument, for example for the training purposes.

Another opportunity of this instrument according to the invention is to be able to fix, through a bar, a trigger that allows the drummer to connect all the drums in a switchboard box for electronic drums.

The advantages of the percussion instruments in accordance with this invention can be summarized as follows:

- Possibility to create low frequency tones by means of the inner resonance box, obtained between the inner and outer circumference of the base ring and the shell of the drum;
- possibility to overlap the two drums when not used, greatly simplifying the transport;
- possibility to have a prolonged sound thanks to the resonant drum positioned below to the batter drum;
- possibility to have infinite tonalities both of tuning and of resonance, through the chassis that bring closer or farther the resonant and batter drum;
- possibility to have a drumset or drum producing an acoustic sound, a mute sound (for training, inserting foam rubber, or any other suitable material, in the acoustic box between membrane and crown), triggered sound (possibility to connect electronic control units as synthesiser of pattern or synthesized sounds).

According to an advantageous embodiment illustrated in FIGS. 5-7, one or more intermediate drums 40 are inserted between the batter drum 10 and the resonant drum 12 and are connected to the support means 32, preferably having a variable extension. The insertion of additional membranes between the two drums 10, 12 allows unlimited sounds' and tuning possibilities. Those intermediate drums 40 could be either batter or resonant. Additionally, the intermediate drums 40 can be provided with rattle 42 or small cymbals or any other percussion instruments able to achieve other sound variations.

According to another embodiment, shown as an example in FIG. 8, in series with the resonant drum 12 one or more auxiliary drums 50 are positioned, even connected to the support means 32, preferably with variable extension. Those auxiliary drums 50 could be batter or resonant. Said drum 50 can be installed with a central opening 22 oriented to the resonant drum 12 or in the opposite direction as shown in FIG. 8. In this case the sound waves will propagate to the outside both from the side openings 20 and from the central opening 22 of the auxiliary drum 50 oriented in the direction of the outside.

Due to the possibility to interchange the drums and/or to install them upside down, the emitted frequencies and the sound transmission can be further arranged to get amazing sound effects. Using the assembly system described in the invention, the number of the assembled drums to create a complete drum can not be limited.

According to a further aspect of the invention, shown in FIGS. 9 and 9*a*, a bass drum 60 is equipped with a membrane retaining ring 62, to which a bass drum platform fit 64 is fixed in such a way to lift the bass drum from the floor. Innovatively, the bass drum platform fit 64 is fixed to the membrane retaining ring 62 with the possibility to adjust the distance of the bass drum platform fit in respect to the batter membrane 66 of the bass drum 60. For example, in the membrane retaining ring 62 is possible to create buttonholes to fix it to the bass drum platform fit 64 by means of screws. Additionally, in correspondence to the bass drum platform fit 64, in the membrane retainer 62, a slit 70 is provided for allowing to move the beater 72 of the pedal 74 towards the batter membrane 66 without interference between the pedal links and the membrane retainer ring 62.

A man skilled in the art, in order to satisfy specific and incidental needs, could operate changes, adaptations and substitutions of components with others functionally equivalent, without departing from the scope of protection as defined by the appended claims. Any of the characteristics described as belonging to a possible embodiment can be made independently of the other forms of realization described.

The invention claimed is:

1. A percussion instrument comprising a batter drum and a resonant drum, each including a ring-shaped base, a lateral wall in the form of a cylindrical shell extending from the periphery of said base, and a membrane extending on and stretched in traction on said peripheral wall by a retaining ring at an end of the wall opposite said ring-shaped base, said drums being spaced from each other with their ring-shaped bases facing one another so as to define a lateral opening for air put in vibration by the respective membranes, and an extendable support interconnecting the batter drum and the resonant drum, said support permitting adjustment of the spacing between the drums.

2. A percussion instrument according to claim 1, wherein the base of each drum has an inner circumference provided in order to define a central opening suitable for allowing the passage of sound waves produced by the vibration of the central area of the membranes and forming the main note of the instrument.

3. A percussion instrument comprising a batter drum and a resonant drum, each including a ring-shaped base, a lateral wall formed by a cylindrical shell extending from the periphery of said base, and a membrane stretched in traction on said peripheral wall by a retaining ring at an end of the wall opposite said ring-shaped base, said drums being spaced from each other with their bases facing one another so as to define a lateral opening for air put in vibration by the respective membranes, wherein the ring-shaped base of each drum has an inner circumference provided to define, with the upper or lower membrane, a sound box suitable to reflect the vibrations produced by the peripheral region of the membrane so as to generate low notes of support for notes hit on the batter drum.

4. A percussion instrument according to claim 1, in which each membrane is put in tension by lugs connected to the external base circumference.

5. A percussion instrument according to claim 1, in which each membrane is fixed to its respective cylindrical shell by a retaining ring, and further comprising tie rods connecting the ring to the base.

6. A percussion instrument according to claim 1, in which the two drums are connected together by means of extendable supporting means, in order to adjustably space the two drums.

7. A percussion instrument according to claim 1, in which one or more intermediate drums are inserted between the batter drum and the resonant drum, said intermediate drums being either batter or resonant drums.

8. A percussion instrument according to claim 7, wherein the intermediate drums are provided with rattle or small cymbals or any other percussion instruments able to achieve other sound variations.

9. A percussion instrument according to claim 1, further comprising at least one auxiliary drum positioned in series with the resonant drum.

10. A percussion instrument according with claim 9, wherein said auxiliary drums are batter or resonant drums and are installed with a central opening oriented to the resonant drum or in the opposite direction.

11. A percussion instrument according to claim 1, wherein the percussion instrument is a bass drum comprising a batter membrane supported on a membrane retaining ring, and further comprising a platform for supporting the bass drum above a floor, said platform supporting a beater and having a pedal linked to the beater, said platform said membrane ring having an adjustable connection whereby the beater can be moved toward or away from the drum membrane.

* * * * *